US010143250B2

(12) United States Patent
Schulz

(10) Patent No.: US 10,143,250 B2
(45) Date of Patent: Dec. 4, 2018

(54) REMOVABLE CLOTHING PATCHES AND ASSOCIATED METHODS

(71) Applicant: Richard R. W. Schulz, Aurora, IL (US)

(72) Inventor: Richard R. W. Schulz, Aurora, IL (US)

( * ) Notice: Subject to any disclaimer, the term of this patent is extended or adjusted under 35 U.S.C. 154(b) by 196 days.

(21) Appl. No.: 14/934,601

(22) Filed: Nov. 6, 2015

(65) Prior Publication Data

US 2016/0128405 A1 May 12, 2016

Related U.S. Application Data

(60) Provisional application No. 62/123,126, filed on Nov. 7, 2014.

(51) Int. Cl.

| | |
|---|---|
| ***A41D 27/08*** | (2006.01) |
| ***B44C 1/10*** | (2006.01) |
| ***D06P 5/28*** | (2006.01) |
| ***D06Q 1/12*** | (2006.01) |
| *A41D 31/00* | (2006.01) |

(52) U.S. Cl.

CPC ..... *A41D 27/08* (2013.01); *B44C 1/10* (2013.01); *D06P 5/004* (2013.01); *D06Q 1/12* (2013.01)

(58) Field of Classification Search

CPC ..... C09J 2423/006; C09J 2431/006; C09J 2400/263; C09J 2467/006; C09J 2475/006; A41D 27/08

See application file for complete search history.

(56) References Cited

U.S. PATENT DOCUMENTS

| | | | | |
|---|---|---|---|---|
| 2,647,261 | A | 8/1953 | Rassner | |
| 5,360,504 | A * | 11/1994 | Fell | A61F 13/15699 156/247 |
| 5,443,875 | A * | 8/1995 | Liu | G09F 3/02 2/115 |
| 5,581,815 | A | 12/1996 | Hans | |
| 5,632,044 | A | 5/1997 | Sloot | |
| 5,773,118 | A | 6/1998 | Eisenpresser | |
| 5,794,267 | A | 8/1998 | Wallace | |
| 5,943,697 | A | 8/1999 | Poskanzer | |
| 6,074,721 | A | 6/2000 | Moore et al. | |
| 6,120,635 | A * | 9/2000 | Sammis | B44C 1/1716 156/230 |
| 6,143,115 | A * | 11/2000 | Sammis | B44C 1/1716 156/230 |
| 6,148,115 | A | 11/2000 | Sammis | |
| 6,231,962 | B1 | 5/2001 | Lipper | |
| 6,397,390 | B1 | 6/2002 | Henderson et al. | |
| 6,810,534 | B2 | 11/2004 | Durkin et al. | |
| 6,982,115 | B2 * | 1/2006 | Poulos | A41D 27/08 156/230 |
| 7,531,230 | B2 | 5/2009 | Marmaropoulos | |
| 7,765,618 | B2 | 8/2010 | Egglesfield | |

(Continued)

*Primary Examiner* — Bobby Muromoto, Jr.

(74) *Attorney, Agent, or Firm* — Charles F. Meroni, Jr.; Meroni & Meroni, PC

(57) ABSTRACT

A customizable garment patch having a least a first layer, the first layer being a printed graphical layer, a second layer attached to the first layer being a fabric substrate layer, the first layer attached to the second layer by sublimation printing, an adhesive applied to the second layer, the adhesive capable of connecting the garment patch to a surface and the adhesive being a water soluble glue.

14 Claims, 2 Drawing Sheets

(56) References Cited

U.S. PATENT DOCUMENTS

| | | | | |
|---|---|---|---|---|
| 7,927,680 | B2 * | 4/2011 | Marshall | B44C 1/105 156/244.16 |
| 8,021,731 | B2 | 9/2011 | Herbig et al. | |
| 8,230,627 | B2 | 7/2012 | Soll et al. | |
| 8,329,284 | B2 | 12/2012 | Seitz | |
| 8,557,379 | B1 * | 10/2013 | Lowe | B32B 27/00 428/353 |
| 8,647,740 | B2 * | 2/2014 | He | B32B 27/00 428/346 |
| 8,658,266 | B2 * | 2/2014 | Lee | B32B 7/12 428/40.1 |
| 8,662,702 | B2 | 3/2014 | Ihm | |
| 8,679,612 | B2 | 3/2014 | Poulos | |
| 2004/0000173 | A1 * | 1/2004 | Keller | D04B 21/16 66/170 |
| 2006/0159734 | A1 * | 7/2006 | Shudo | A61F 7/10 424/448 |
| 2006/0201034 | A1 * | 9/2006 | Ambrogio | A43B 3/24 36/101 |
| 2007/0036847 | A1 * | 2/2007 | Yoshinaga | A61K 9/7053 424/448 |
| 2008/0038328 | A1 * | 2/2008 | Higo | A61K 9/7053 424/448 |
| 2008/0152796 | A1 | 6/2008 | Collier | |
| 2008/0295960 | A1 * | 12/2008 | Schalau, II | A61K 9/7007 156/329 |
| 2011/0020586 | A1 | 1/2011 | Poulos | |
| 2011/0305006 | A1 | 12/2011 | Hehenberger | |
| 2013/0062230 | A1 | 3/2013 | Mattingly | |
| 2016/0214348 | A1 * | 7/2016 | Louks-Phillips | B32B 7/06 |

* cited by examiner

REMOVABLE CLOTHING PATCHES AND ASSOCIATED METHODS

This application claims the benefit of U.S. Provisional Application No. 62/123,126 filed Nov. 7, 2014.

BACKGROUND OF THE INVENTION

Field of the Invention

The present invention generally relates to removable clothing patches for application to clothing or other similar articles and associated methods of application and manufacture. More particularly, the present invention relates to a set or sets of clothing patches that can be applied to clothing, folders, upholstery, blankets, towels, windows, walls and other surfaces for decorative purposes.

Discussion of the Prior Art

U.S. Pat. No. 5,581,815 ('815 Patent), which issued to Hans, discloses a Garment for Displaying Information Panels. The '815 Patent describes a garment for the purpose of attaching and displaying information panels, such as a competitor's racing bib. One or more flexible flap members are permanently attached to the garment. Each distal end of the flexible flaps has a means of fastening, such as a snap fastener. Complementary means of fastening are permanently attached either to the garment, or to the proximal portion of the flexible flap. When the information panel is held in position, the complementary fasteners are coupled to secure the information panel. The garment may be worn without the information panels, as some information panels may be of a very temporary basis.

U.S. Pat. No. 5,773,118 ('118 Patent), which issued to Eisenpresser, discloses a Decorative Fabric and Method for Making the Same. The '118 Patent describes a fabric material or construction having a decal and ornaments bonded and affixed, respectively thereto, whereby the ornaments overlap and have the same configuration as the decal so that the decal is no longer visible when the ornaments are affixed.

U.S. Pat. No. 5,943,697 ('697 Patent), which issued to Poskanzer, discloses Children's Clothing with Removable Adhesively Attached Stickers. The '687 Patent describes an adaptable garment that permits a child complete flexibility in placing educational or entertainment articles thereon is disclosed. The adaptable garment includes one or more removable adhesively attachable stickers, which preferably include a pressure-sensitive acrylic adhesive layer, and a garment having a sufficiently rough surface to permit reversible adhesion with the stickers. The stickers are adhesively attached to the rough surface of the garment and are capable of being removed and relocated to substantially any other location on the rough surface of the garment by a child wearing the garment.

U.S. Pat. No. 6,074,721 ('721 Patent), which issued to Moore et al., discloses Temporary Tatoo Decals. The '721 Patent describes a temporary decal comprising a porous paper base coated with a water-soluble slip layer (e.g., dextrin gum) on which offset printing inks are directly imprinted using a high speed lithographic press. The inks are printed in a designated area only, in a desired image. A clear spot coating, preferably of an aqueous material, is then printed over the image area only.

A contact adhesive is then spot printed over the image area of each decal, preferably using a silk screen press. A removable cover sheet, such as a silicone-coated sheet, is placed over the contact adhesive of each printed sheet of decals to keep the sheets from sticking together. The spot coating acts as a protective layer that keeps the contact adhesive from migrating to the surface of the decal after the finished temporary tattoo is applied to the skin. Without the spot coating, the surface of the decal would become sticky to the touch and the decal would come off faster because of friction with the surrounding environment.

U.S. Pat. No. 6,397,390 ('390 Patent), which issued to Henderson et al., describes a Garment for Communicating Through Removable Messages. The '390 Patent discloses an article for communicating at least one message which includes a garment, at least one detachable message, and a securing mechanism for detachably adhering the at least one detachable message to the garment.

The securing mechanism is selected from a perforated segment, a snap, Velcro, a button, a magnet, electrostatic forces, a rubber adhesive, and an acrylic adhesive. The garment is formed of a disposable material such as paper or a webbed material or a non-disposable material such as cotton, polyester, spandex, a combination thereof, or the like. Similarly, the at least one detachable message is alternately formed of with a disposable or non-disposable material.

U.S. Pat. No. 6,982,115 ('115 Patent), which issued to Poulos et al., describes an Interactive-Design Garment Where the Wearer can Create and Alter the Graphic Decoration on the Garment and Method of Manufacture. The '115 Patent discloses an interactive-design garment which has heat-affixed thereto a flexible substrate formed of a laminate including a layer of plastisol ink which includes a primary graphic image therein of a particular theme and a plurality of flexible PVC sheet appliques which have secondary graphic images thereon and are positionable onto the substrate by a user to cooperate artistically with the graphic theme of said substrate on the garment.

U.S. Pat. No. 7,765,618 ('618 Patent), which issued to Egglesfield, describes Clothing with Detachable Symbols. The '618 Patent discloses an article of clothing comprises four layers. A first layer of fabric is in the form of a wearable garment. A second layer of synthetic tricot fabric is attached to the first layer. A third layer of foam has the same shape and size as the second layer, is aligned with the second layer, and is heat fused to a horizontal fiber size of the tricot fabric.

A fourth layer of loop material has the same shape and size as the third layer, is aligned with the third layer, has two sides both of which comprise nylon loops, and is heat fused to the fourth layer. A display item of a plurality of display items has a substantially smooth front portion and a back portion having a plurality of hooks. The display items are attachable and rearrangeable by joining the plurality of hooks to the loops of the fourth layer.

U.S. Pat. No. 7,927,680 ('680 Patent), which issued to Marshall, describes a Temporary Facial Decal. The '680 Patent discloses a temporary facial decal comprising a mask-like substrate having apertures for the eyes and mouth and having a nose opening taken from the group of slit and aperture with the body of the mask having a transferable image thereon covered by a removable protective sheet that is removed from the decal which is then placed on the user's face using the provided apertures for alignment whereupon an agent, preferably water, is used to transfer the image onto the user's face.

U.S. Pat. No. 8,021,731 ('731 Patent), which issued to Herbig et al., describes an Adhesive Sheet and Method. The '731 Patent discloses an adhesive sheet for use in affixing a badge to a garment comprises a plurality of cutouts, each cutout having a shape that approximately matches a shape of a badge.

U.S. Pat. No. 8,557,379 ('379 Patent), which issued to Lowe, describes a Multi-Layer Graphic Article. The '379 Patent discloses a multilayer graphic article includes (a) a fabric matrix or support having an upper and lower surface, (b) at least one image layer disposed on the upper surface of the fabric matrix or support, (c) a protective layer disposed over the at least one image layer, and, (d) an adhesive layer adhered to the lower surface of the fabric matrix or support.

U.S. Pat. No. 8,658,266 ('266 Patent), which issued to Lee, describes a Readable, Repositionable and Reusable Adhesive Fabric Paper for Printing and Manufacturing Method of the Same. The '266 Patent describes an adhesive fabric paper for printing is used to color printers for personal computers, printing machines for indoor and outdoor advertising, wide format printers, plotters to print colored images. The manufacturing method includes: heating and cooling a woven fabric; preparing a first "S" coating liquid, a second "S" coating liquid and an "R" coating liquid as coating liquids to be coated on the front face of the fabric and maturing them for three days; coating twice the rear face of the fabric; coating once the rear face of the fabric; carrying out first and second "S" coating works on the front face of the fabric with the first "S" coating liquid and the second "S" coating liquid; coating twice the front face of the fabric with the "R" coating liquid; and laminating a backer coated with an adhesive to the fabric.

U.S. Pat. No. 8,661,702 ('702 Patent), which issued to Ihm, describes a Kit and Method for Assembling a Decorative Object Pattern upon a Separate Article. The '702 Patent discloses a kit and method for assembling a decorative object pattern upon a fabric article including a flat, smooth surface board, a desired number of individual stencil units, slidably situated upon the board, and held movably in place by magnetic force. The stencil units are arranged upon the board surface to create a desired stencil design. Rhinestones or other decorative objects are situated within the stencil pattern with their adhesive side down. An adhesive backed cover sheet is provided to hold the decorative object pattern in place. The cover sheet is adapted to being placed on the fabric surface, and the held objects adhered thereto.

U.S. Pat. No. 8,679,612 ('612 Patent), which issued to Poulos, describes a Craft Fabric. The '612 Patent discloses a fabric material for use in craft activities, the fabric material comprising a textile substrate and a pressure sensitive adhesive carried by opposite surfaces of the substrate, whereby upon the application of pressure to one piece of the fabric material against another piece of the fabric material causes the adhesion of the pieces of fabric.

United States Patent Application Publication No. US 2008/0152796 which is authored by Collier, teaches a method of producing a reflective design which includes the steps of lasering a pattern on an adhesive side of a reflective laminated material. The lasering ablates the adhesive and causes these areas to not adhere. The reflective laminate material is applied to a substrate. A carrier layer of the reflective laminate is removed to produce a reflective design on the substrate. This method allows for highly customized designs at a reasonable cost that are very visually appealing. The substrate may be a textile, paper, or decal material. The textile may be the garment or may be a patch that is sewn onto a garment or applied to the garment with an adhesive.

United States Patent Application Publication No. US 2011/0020586, which is authored by Poulos, teaches a fabric material for use in craft activities, the fabric material comprising a textile substrate and a pressure sensitive adhesive carried by opposite surfaces of the substrate, whereby upon the application of pressure to one piece of the fabric material against another piece of the fabric material causes the adhesion of the pieces of fabric.

SUMMARY OF THE INVENTION

Decorative patches and adornments to clothing are used for customizing a user's own clothing to their desires, and for providing signaling in more formal environments. This allows a user to express their own creativity and self-expression. However, most patches that are commercially available are difficult to use in temporary or semi-permanent arrangements. This is because they often require mechanical attachments to the clothing, or a chemical bond that leaves residue when the patch is removed. Other temporary clothing patches lack durability and cannot hold up to multiple applications and/or rearrangements onto different articles of clothing. Thus there is a need for a removable and reusable fabric patch that contains customizable graphic designs. Specifically, the present invention provides a fabric patch having a decal or ornamental design. The product can be combined into sets, units of which can be arranged or fitted together in a variety of ways in a do-it-yourself (DIY) manner, or can be sold individually in an a-la-carte fashion. Certain embodiments will compose universal puzzles for creating designs, mosaics, and other artistic expressions. Patches can be applied to, for example, clothing, folders, backpacks, car seats, blankets, towels, windows, walls, and the like for decorative purposes to suit the users' aesthetic needs.

In one embodiment the invention considers a customizable garment patch having at least a first layer, the first layer being a printed graphical layer, a second layer attached to the first layer being a fabric substrate layer, the first layer attached to the second layer by sublimation printing, an adhesive applied to the second layer, the adhesive capable of connecting the garment patch to a surface, the adhesive being a water soluble glue.

In another embodiment the invention considers an adaptable garment having at least one or more, repeatedly relocatable attachable patches having an adhesive thereon, and a base garment having a sufficiently rough surface to permit adhesion with said patches, said patches being attached to said rough surface of said base garment by said adhesive and capable of being removed and relocated to substantially any other location on said rough surface of said base garment.

In another embodiment, the invention considers a method of fabricating an ornamental garment patch having at least the steps of, creating a design and cutting instructions stored as an art file on a computer readable medium, providing a template sheet of fabric, printing the design onto the template sheet, and cutting the ornamental garment patch from the template sheet by a laser cutter apparatus following instructions provided by the art file.

Such embodiments do not represent the full scope of the invention. Reference is made therefore to the claims herein for interpreting the full scope of the invention. Other objects of the present invention, as well as particular features, elements, and advantages thereof, will be elucidated or become apparent from, the following description and the accompanying drawing figures.

BRIEF DESCRIPTION OF THE DRAWINGS

Other features of my invention will become more evident from a consideration of the following brief descriptions of drawings.

DETAILED DESCRIPTION OF THE PREFERRED EMBODIMENT

Figure 1:
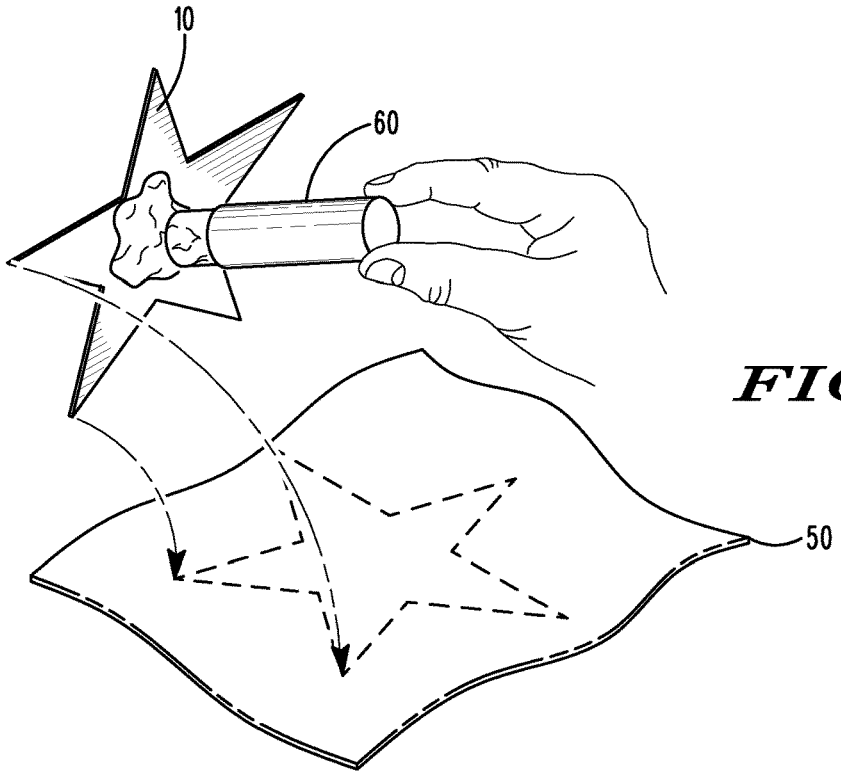
FIG. 1 is a perspective view of an exemplary removable clothing patch and attachment method.

Referring now the drawings with more specificity, the present invention essentially provides a removable clothing patch or clothing decal as at 10 in the form of a layered clothing patch that can be attached and detached from clothing using temporary, semi-permanent, and permanent means. The clothing patch 10 according to the present invention preferably comprises a three-dimensional construction comprised of two or more differing layers, the first layer being a graphical layer 11 and the second comprising at least a fabric layer 12. Clothing patch 10 may preferably be attached to fabric substrate 50 by use of a gluestick 60 or other adhesive means 15.

The clothing patch 10 is preferably constructed from a machine washable fabric or other flexible material. Preferably, the fabric is a polyester fabric which is capable of being cut using machine cutting or a laser cutter 30. Preferably, if laser cutting is used in manufacture, the fabric is one which does not burn during laser cutting, and preferably is a fabric that creates an unfrayed edge. The polyester fabric preferably does not shrink when washed and/or dried using machine washers/dryers, and may preferably capable of stretching in both directions resulting from a simplex knit or "V" shape pattern knit. Preferably the fabric may be crafted from 40 denier semi dull polyester, 70 denier texturized polyester, or higher denier polyesters depending on strength needs of the patch application. The fabric may preferably have a matte finish or a gloss or high gloss finish. In certain other embodiments the patch is composed of cotton, leather, vinyl, and/or silk, depending on the user's mechanical and aesthetic desires.

Patch 10 may be fabricated using any color or combination of colors. Patches may also be virtually unlimited in shape. The garment pieces can be shaped, by way of example, as hearts, stars, circles, rectangles, and the like. Further, patches may be shaped into logos of sporting teams, political campaigns, and other means of conveying information or allegiances. In further embodiments of the present invention, the garment pieces are seasonal, wherein the garment pieces contain holiday messages such as "Merry Christmas," etc. In a preferred embodiment of the present invention, the garment pieces may be arranged or located in any pattern or location on a garment. For example, several patches may form a singular pattern or set of patterns when arranged on a garment in a puzzle-type fashion. Patches may also form adaptable, customizable, designs such as a chessboard and chess pieces, in which the user can decide the process of the demonstrated chess game.

The clothing patch 10 is preferably attachable, detachable, and re-attachable to a fabric 50 as seen in FIG. 1. Preferably, patch 10 is attached using a glue stick 60. Glue stick 60 creates adhesive layer 15 which attaches patch 10 to fabric 50. In a preferred embodiment adhesive 15 composes a water soluble glue, having a specific gravity between 1.01 and 1.10, which dissolves when clothes or fabric 50 is washed. Then patch 10 falls off of the fabric 50 and is reusable. Other temporary adhesives include: pressure-sensitive adhesives such as tackified rubber adhesives, i.e. natural rubber, olefins, silicones, polyisoprene, polybutadiene, polyurethanes, styrene-isoprene-styrene and styrene-butadiene-styrene block copolymers, and other elastomers; and tackified or untackified acrylic adhesives such as copolymers of isooctylacrylate and acrylic acid, which can be polymerized by radiation, solution, suspension, or emulsion techniques. In certain embodiments, more permanent means of attachment such as permanent glue or stitching. In other embodiments more temporary means of affixation such as stickers, magnets, or hook and loop fasteners (Velcro) are used. Depending on the desires of the user and the shape of the patch a user may form a pocket as well as for merely decorative means. Buttons and other adornments may optionally be used in such an implementation.

Figure 2A:
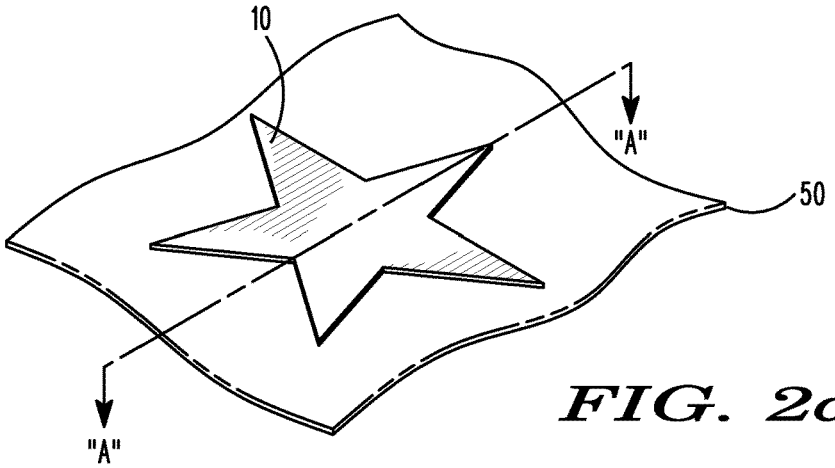
FIG. 2*a* is a perspective view of an exemplary clothing patch attached to a base fabric.
Figure 2B:
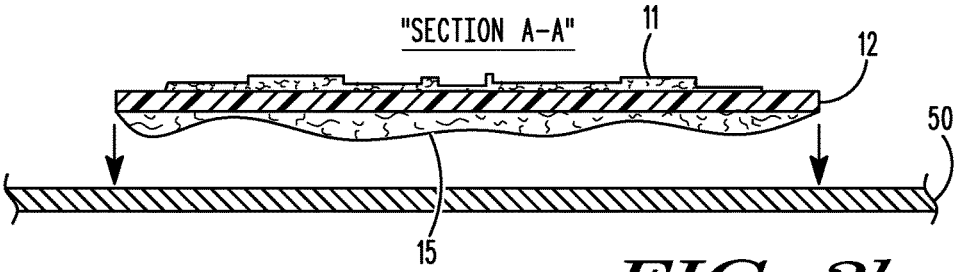
FIG. 2*b* is a cross sectional view of the exemplary clothing patch and fabric of FIG. 2*a*.

Looking now to FIGS. 2*a*, 2*b* an exemplary embodiment of patch 10 attached to exemplary fabric 50 is shown. In cross sectional view 2*b*, patch 10 is shown. Patch 10 preferably comprises at least a first graphical layer 11 and a second fabric or backing layer 12. The graphical layer 11 adheres to fabric layer 12 and preferably may be deposited on layer 12 by sublimation and deposition printing, preferably direct dye sublimation printing uses dispersed inks. The graphics 11 are printed or affixed to the front of patch 10 are preferably comprised of printed ink, regular ink, shiny ink, glitter ink, plastic, embroidery, and/or screen prints. Preferably, the ink or printing is deposited on fabric layer 12 using sublimation, which is best used in combination with a polyester fabric. Fabric layer 12 is preferably coated with adhesive means 15 for affixing patch 10 to fabric 50, which preferably comprises temporary glue described herein.

It can be appreciated that patch 10 can be placed against a garment or other fabric or porous surface in place of fabric 50 and removably secured in place by engagement of adhesive 15 as seen in FIG. 2*a*. These patches When it is desired to remove patch 10, the patches are selectively disengaged patch 10 is removed. Depending on the adhesive 15 used, the patches are capable of being continually removed and replaced without damage to the garment or patch.

Figure 3:
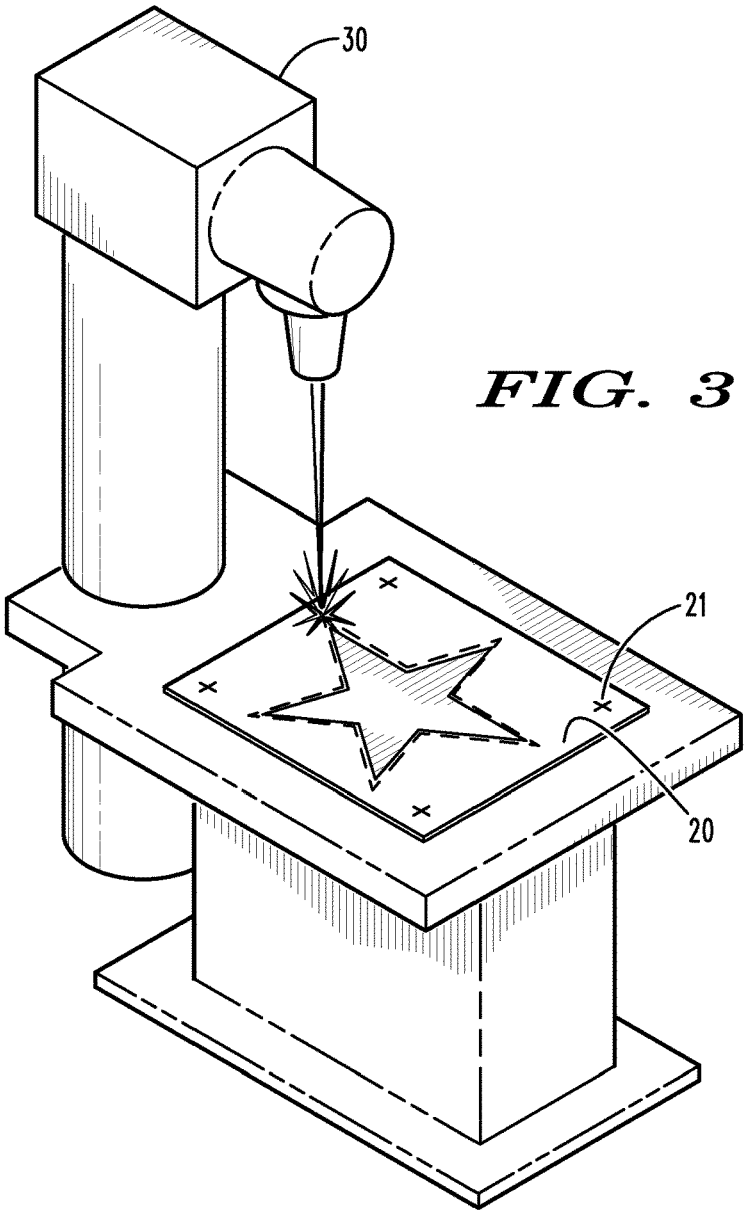
FIG. 3 is a perspective view of exemplary method of manufacture of removable clothing patches.
Figure 4:
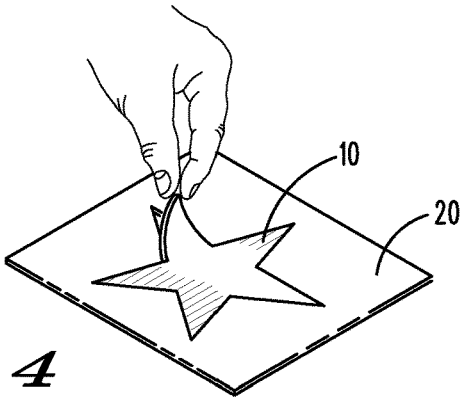
FIG. 4 is a perspective view of an exemplary clothing patch being removed from a larger sheet of fabric following cutting.

Manufacture of removable patch 10 is preferably from a sizable printed polyester fabric. Prior to manufacture an art file is typically created using a computer and graphics processing program. The art file contains information pertaining to a large template of fabric 20. The art file contains information on graphics, bleed lines, cut lines, and registration marks 21 placed on template 20. Once the art file is completed, it is printed onto template sheet 20 using sublimation printing. Sublimation printing provides superior sharpness and significant cost savings, particularly when used in combination with polyester fabric. After printing registration marks 21 are aligned to known locations and preselected designs corresponding to removable patch 10 are cut out of template 20 preferably by way of a laser cutter 30 as in FIG. 3. Laser cutting is preferable to mechanical cutting as it is capable of fusing and/or melting the edges of patch 10 preventing fraying of the patch even during machine washing. Following cutting patch 10 is removed from template 20 as in FIG. 4.

Affixing a patch 10 on fabric 50 as generally shown in FIG. 1 essentially comprises providing the patch 10 and, fabric 50, positioning the patch on the desired location of the fabric, applying a bonding means 15 to the patch 10 and bonding the patch to the fabric 50.

Accordingly, although the invention has been described by reference to certain preferred and alternative embodiments, it is not intended that the novel arrangements be limited thereby, but that modifications thereof are intended to be included as falling within the broad scope and spirit of the foregoing disclosures and the appended drawings.

I claim:

1. A customizable garment patch comprising:

a first layer, the first layer being a printed graphical layer;

a second layer attached to the first layer being a fabric substrate layer;

a third layer of three dimensional graphical adornments attached to the first layer, the graphical adornments forming right angle shapes when viewed along a sectional view;

the first layer attached to the second layer by sublimation printing;

an adhesive applied to the second layer, the adhesive capable of connecting the garment patch to a surface;

the adhesive being a water soluble glue.

2. The customizable garment patch of claim 1 wherein:

the first layer comprises dispersed inks deposited onto the second layer by direct dye sublimation printing.

3. The customizable garment patch of claim 1 wherein:

the second layer comprises a machine washable polyester having a simplex knit.

4. The customizable garment patch of claim 3 wherein:

the second layer is comprised of at least 40 denier polyester fabric.

5. The customizable garment patch of claim 1 wherein:

the adhesive is a water soluble gluestick having a specific gravity of 1.01-1.10.

6. The customizable garment patch of claim 5 wherein:

the adhesive dries to a clear, colorless, and transparent state.

7. An adaptable article comprising:

one or more, repeatedly relocatable attachable patches having an adhesive thereon; and a base garment having a sufficiently rough surface to permit adhesion with said patches;

said patches being attached to said rough surface of said base garment by said adhesive and capable of being removed and relocated to substantially any other location on said rough surface of said base garment;

said patches having three dimensional graphical adornments attached to the first layer, the graphical adornments forming right angle shapes when viewed along a sectional view.

8. The adaptable article of claim 7 wherein:

the base garment has a void or hole at the attachment point of the patches.

9. The adaptable article of claim 7 wherein:

the adhesive is a water soluble gluestick having a specific gravity of 1.01-1.10.

10. The adaptable article of claim 7 wherein:

said one or more repeatedly relocatable patches comprise at least a first layer and a second layer;

the first layer comprising dispersed inks deposited onto the second layer by direct dye sublimation printing;

the second layer comprises a machine washable polyester having a simplex knit.

11. The adaptable article of claim 10 wherein the second layer is comprised of at least 40 denier polyester fabric.

12. The garment patch of claim 1 wherein the patch is reusable.

13. The garment patch of claim 1 wherein the patch is washable and dryable.

14. The garment patch of claim 1 wherein a user can apply and re-apply the glue.

* * * * *